US005143483A

United States Patent [19]

Petersen

[11] Patent Number: 5,143,483

[45] Date of Patent: Sep. 1, 1992

[54] HYDRAULIC STAB SUBASSEMBLY FOR REMOTELY OPERATED VEHICLE VERTICAL INTERFACE TOOL

[75] Inventor: William H. Petersen, Mandeville, La.

[73] Assignee: Shell Offshore Inc., Houston, Tex.

[21] Appl. No.: 695,876

[22] Filed: May 6, 1991

[51] Int. Cl.[5] ..... F16L 1/12

[52] U.S. Cl. ..... 405/191; 166/340; 405/169

[58] Field of Search ..... 405/169, 188, 190, 191; 166/340, 344, 347; 285/96

[56] References Cited

U.S. PATENT DOCUMENTS

| | | | |
|---|---|---|---|
| 3,121,570 | 2/1964 | Gilbert | 277/34 |
| 3,675,713 | 7/1972 | Watkins | 166/340 |
| 3,693,714 | 9/1972 | Baugh | 166/6 |
| 3,944,263 | 3/1976 | Arnold | 285/96 |
| 4,364,433 | 12/1982 | Fisher et al. | 166/399 |
| 4,489,959 | 12/1984 | Satterwhite | 285/18 |
| 4,558,890 | 12/1985 | Schartz | 285/13 |
| 4,662,657 | 5/1987 | Harvey et al. | 285/96 |
| 4,682,913 | 7/1987 | Shatto et al. | 405/169 |
| 4,683,912 | 8/1987 | Dubrosky | 137/580 |
| 4,863,314 | 9/1989 | Baugh | 405/191 |
| 4,878,783 | 11/1989 | Baugh | 405/169 |

*Primary Examiner*—David H. Corbin

[57] ABSTRACT

An hydraulic stab sub for use in a remote location that can be inserted into a receptacle with the seals in a retracted position. The seals are expanded to a sealing portion using hydraulic pressure while an hydraulic piston is provided for removing the stab sub from the receptacle.

9 Claims, 2 Drawing Sheets

HYDRAULIC STAB SUBASSEMBLY FOR REMOTELY OPERATED VEHICLE VERTICAL INTERFACE TOOL

BACKGROUND OF THE INVENTION

The present invention relates to a method and apparatus for use in connecting a multi-line fluid conduit carried by a remotely operated vehicle (ROV) or directly connected to a surface vessel to a subsea equipment assembly such as an hydraulically actuated device.

U.S. Pat. No. 4,682,931 describes a system for effecting a fluid connection between a subsea wellhead assembly and the surface so that hydraulic pressure may be supplied to the well head assembly to actuate various devices. As described in the patent, the system comprises a receptacle which is mounted on the subsea wellhead and provided with suitable hydraulic ports to which fluid may be supplied to effect the desired operations. A probe or stab sub is inserted into the receptacle and is provided with hydraulic ports that align with the ports in the receptacle when the stab sub is properly positioned. The stab sub is held in place by a vacuum means while an effective seal is provided between the stab sub and the receptacle by "O" rings or similar sealing devices.

In U.S. Pat. No. 4,863,314 there is described a hydraulic connection similar to that described in the above patent but with provisions for making a frictionless connection. As explained in this patent, the force that can be exerted by an ROV is very limited since it has nothing to react against to exert force. Thus, the use of "O" rings for effecting a seal between the stab sub and the receptacle is limited to those cases where the force required to insert the stab sub is in the range of 30 pounds. This effectively eliminates the use of conventional "O" rings in a subsea environment if the stab sub has a diameter greater than approximately one inch. For example, as the stab sub approaches 4 inches in diameter, the force required to insert it using conventional "O" ring construction in the receptacle would exceed 100 pounds.

The '314 patent solves the problem by providing a frictionless connection which is easily inserted into the receptacle and then utilizes mechanical means for forcing a seal means into contact with the receptacle. More particularly, the patent discloses the use of "O" rings which are retracted to a first position in which their outer diameter is equal to or less than the diameter of the stab sub and are then expanded outwardly to effect a seal. The "O" rings are expanded by means of a sleeve which is moved axially with respect to the stab sub to force the "O" rings into a sealing engagement with the wall of the receptacle. While the invention of the '314 patent solves the problem of providing an hydraulic stab sub which may be inserted into a receptacle mounted on a subsea wellhead, it does have several problems. For example, the invention utilizes an axial sleeve which must be reciprocated within the stab sub to move the "O" rings into a sealing position. The use of the reciprocating sleeve is undesirable in subsea equipment since it can be rendered inoperative by debris which may enter into the stab sub. Further, the axial sleeve requires considerable force to move in order to move the "O" rings into sealing engagement. Also, there is reliance upon the elasticity of the "O" rings to effectively retract them after the sleeve has been moved to a position in which the "O" rings can retract into their original shape. In cases where the stab sub has been in position for an extended period of time, the possibility exists that the axial sleeve will not retract to allow the "O" rings to retract to their original position. Thus, the stab sub will be effectively stuck in the receptacle.

SUMMARY OF THE INVENTION

The present invention solves the above problems by providing a simplified means for expanding the "O" rings radially outward to effect a hydraulic seal between the stab sub and the subsea receptacle. In particular, the present invention utilizes "O" rings which are disposed in circumferential grooves formed on the outer surface of the stab sub and sized so that the "O" rings form an effective hydraulic seal between the "O" rings and the walls of the groove. Hydraulic pressure is then applied to the inner diameter of the "O" ring to force the "O" ring radially outward in the groove to effect a seal between the "O" ring and the wall of the receptacle. The use of hydraulic pressure for moving the "O" rings radially outward into a sealing position eliminates the reciprocating sleeve utilized in the above patent. Since no mechanical devices are involved in moving the "O" ring, the reliability of the stab sub will be greatly increased.

The stab sub of the present invention also includes a means for positively removing the stab sub from the receptacle after the "O" rings have been retracted into their original position. To retract the "O" rings, the hydraulic pressure is removed from the inner diameter of the "O" rings and the "O" rings are allowed to relax to their original shape and dimensions. If in fact the "O" rings do not relax due to the time the stab sub has been in place, the positive removal means can be utilized to remove the stab sub from the receptacle. The removal means comprises an hydraulic piston which is mounted in a central bore in the stab sub. By applying pressure to the piston a rod is extended from the end of the stab sub to contact a fixed surface on the receptacle and physically jack the stab sub out of the receptacle. A spring means is utilized to return the hydraulic piston to a normal at rest position after the stab sub has been removed from the receptacle and the hydraulic pressure removed from the top of the piston.

BRIEF DESCRIPTION OF THE DRAWINGS

The present invention will be understood from the following description when taken in conjunction with the attached drawings in which.

DESCRIPTION OF THE PREFERRED EMBODIMENT

Figures 1A, 1B:
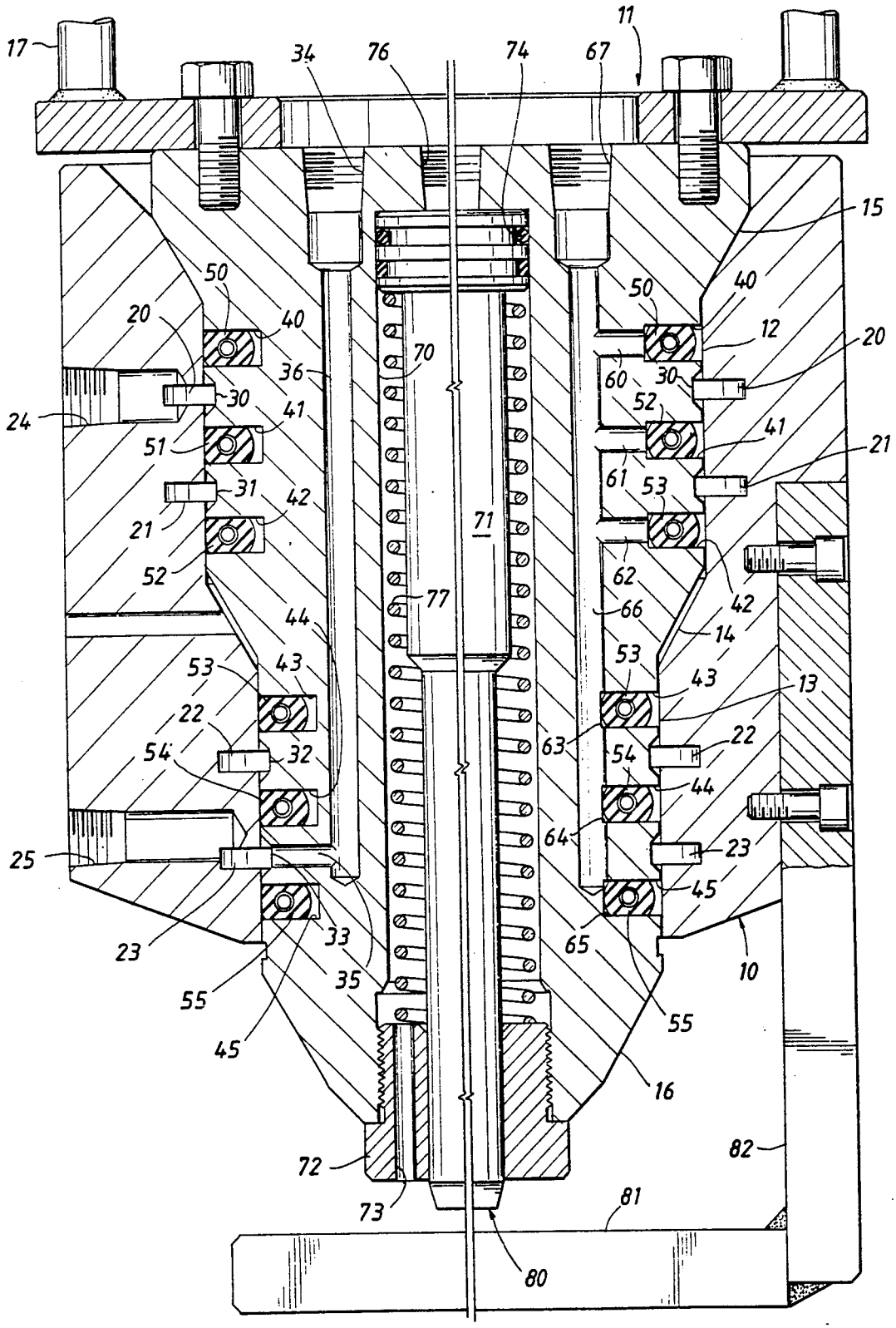
FIGS. 1A and 1B are vertical sections of a stab sub constructed according to the present invention.

Referring to the drawings there is shown a receptacle 10 which is mounted on a subsea component for receiving an hydraulic stab sub so that hydraulic pressure may be provided to the assembly to actuate various items. As described in the referenced patents, the items to be actuated may comprise blowout preventers, valves, or other hydraulic devices. The hydraulic stab sub 11 is designed to cooperate with the receptacle to provide the necessary hydraulic connections. The receptacle is provided with two straight cylindrical bores, 12 and 13, which are joined by a tapered surface 14. Similarly, a tapered surface 15 is provided on the left hand end of the receptacle as shown in the drawings to facilitate insertion of the stab sub into the receptacle. To further facilitate the insertion of the stab sub, it is provided with a tapered nose 16 which will assist in aligning the stab sub with the bores of the receptacle and allow its insertion as described in U.S. Pat. No. 4,682,931.

Figure 2:
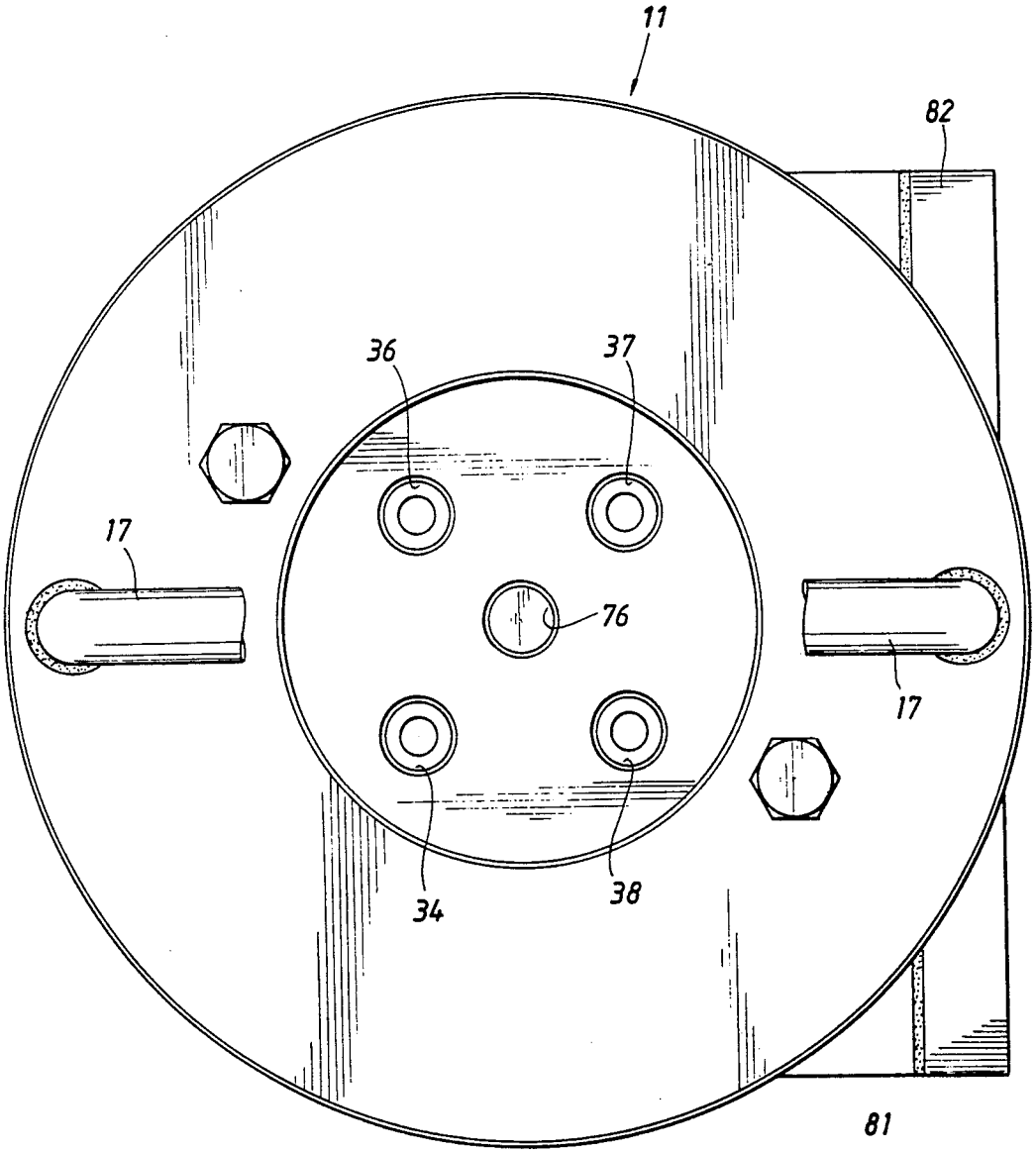
FIG. 2 is a top or end view of the stab sub shown in FIG. 1.

The inner wall of the receptacle is provided with four annular grooves 20, 21, 22 and 23 having a rectangular cross section. While four grooves are shown, obviously a different number could be used depending upon the number of connections required. These grooves provide non-oriented hydraulic communication between the receptacle and the various items to be operated. As shown in FIG. 1, the groove 20 communicates with one hydraulic connection 24 while the groove 23 communicates with the hydraulic connection 25. The grooves 21 and 22 communicate with similar hydraulic connections not shown in the Figure. The outer surface of the hydraulic stab sub is provided with similar annular grooves or recesses 30, 31, 32 and 33. These grooves are so positioned axially along the hydraulic stab sub so that when the cooperating surface of the stab sub contacts the surface 15 of the receptacle as shown in FIG. 1, the recesses or annular grooves 30–33 are aligned with the recesses or annular grooves 20–23 formed in the receptacle as shown in the Figure. The recess 33 in the stab sub is coupled to hydraulic connection 34 by means of elongated bore 36 formed in the stab sub. The bore 36 at the bottom communicates by means of a short radial passage 35 with the recess 33. This construction provides a means by which hydraulic communication may be provided between the ROV or pressure source and a particular item on the subsea assembly. The remaining recesses 30, 31 and 32 in the stab sub communicate with hydraulic connections 36, 37 and 38 shown in FIG. 2 through bores in the stab sub (not shown in FIG. 1).

A series of annular rectangular shaped grooves are formed on the outer surface of the stab sub as shown at 40, 41, 42, 43, 44 and 45. Each of the grooves is provided with an "O" ring type sealing means 50, 51, 52, 53, 54, and 55 as shown. The grooves are sized so that the "O" rings will effect an hydraulic seal between the radial walls of the grooves and the area on the outer and inner diameters of the "O" rings. While "O" rings are preferred, other types of expandable seals could be used, for example, sealing rings having a rectangular cross section.

The "O" rings are positioned so that, when expanded, they will effectively isolate the individual grooves 20–23 formed in the receptacle from the atmosphere surrounding the wellhead and allow hydraulic pressure to be selectively applied to the desired location. The "O" rings are moved radially outward by supplying hydraulic pressure to the inner diameters of the "O" rings as shown in the lower half of FIG. 1. More particularly, an elongated bore 66 is provided in the hydraulic stab sub and connected to a source of hydraulic pressure on the ROV through a connection 67. Three radial bores, 60, 61 and 62, are provided in the stab sub to provide hydraulic communication between the bore 66 and the inner diameter of the "O" rings 50, 52 and 53 as shown. Openings 63, 64 and 65 are provided at the bottom of the bore 66 to effect hydraulic communication with the "O" rings 53, 54 and 55. When hydraulic pressure is supplied to the inner diameter of the "O" rings, they will be moved radially outward and form an effective seal with the bores 12 and 13 of the receptacle, respectively, as shown in FIG. 1.

A positive means comprising hydraulic piston 71 is provided for forcefully removing the hydraulic stab sub from the receptacle. The hydraulic piston is mounted in a central bore 70 formed in the stab sub. The lower end of the bore is closed by a bushing 72 which serves to provide support for the lower end of the hydraulic piston as well as a reaction point for the compression spring 77 which is used to return the piston to its at rest position. The piston is provided with a chevron-type seal means 75 and an "O" ring 74 at its left hand end. Hydraulic pressure is provided to the left hand end of the piston through a connection 76 to force the piston to the right to forcefully separate the hydraulic stab sub from the receptacle. The left hand end 80 of the piston reacts with a reaction plate 81 which is mounted on an arm 82. The arm 82 is firmly attached to the receptacle which in turn is securely attached to the subsea component.

From the above description, it can be seen that the invention has provided a simple hydraulic stab sub that does not rely upon the movement of sleeves or other devices for expanding the sealing means into sealing engagement with the receptacle mounted on the wellhead. In place of the reciprocating sleeve hydraulic means are used for expanding the sealing means into sealing engagement. While this effects an hydraulic seal with the receptacle, it still permits a frictionless insertion of the stab sub into the receptacle.

The invention also provides a positive means for forcefully removing or jacking the sub from the receptacle to overcome any friction between the sealing means and the receptacle. After exposure to subsea elements and hydraulic pressure it is possible that the sealing means will take a permanent set and thus not retract when the pressure used to force them radially outward is removed. Thus, the invention provides a simple means for expanding the seals into engagement with the receptacle and a positive means for removing the sub from the receptacle when desired.

What is claimed is:

1. An hydraulic stab sub for inserting into a remote receptacle for establishing hydraulic communication with the receptacle, said stab sub comprising:

at least one seal means, said seal means being disposed on said stab sub and being movable radially between the first position in which it is retracted to a position at least in line with the outer surface of the stab and a second position in which it is radially expanded into sealing engagement with the surface of said receptacle; and means for applying hydraulic pressure to said seal means to move it radially outward into sealing engagement with the surface of said receptacle.

2. The hydraulic stab sub of claim 1 and in addition means disposed on the stab sub for positive removal of said stab sub from said receptacle when said seal means is in a retracted position.

3. The hydraulic stab sub of claim 2 wherein said additional means comprises an hydraulic piston that is movable between a first position wherein said stab sub can be inserted into the receptacle and a second position where said stab sub is forced from said receptacle.

4. An apparatus for establishing hydraulic communication with subsea equipment, comprising:

a receptacle, said receptacle being disposed on said equipment and including at least one hydraulic connection to said equipment, said connection terminating in a port opening in the inner wall of said receptacle;

a stab sub, said stab sub being adapted for inserting into said receptacle by a remotely operated vehicle, said stab sub including a hydraulic connection that terminates in a port opening in the outer wall of said stab sub, said port opening in said stab sub being aligned with the port opening in said receptacle when said stab sub is inserted in said receptacle;

a first groove formed in the outer wall of said stab sub on one side of said port opening and a second groove formed in the outer wall of said stab sub on the other side of said port opening;

a pair of annular sealing rings, one sealing ring being disposed in each of said grooves, said sealing rings forming an hydraulic seal with the surface of said grooves and having a normal outer diameter that is equal to or less than the outer diameter of the stab sub;

a second hydraulic connection formed in said stab sub, said second hydraulic connection terminating in a pair of port openings, one of said pair of port openings being disposed in each groove to apply hydraulic pressure to expand said sealing rings radially outward whereby said stab sub may be inserted into said receptacle with the sealing rings at their normal diameter and hydraulic pressure applied to expand the sealing rings radially outward into sealing engagement with the wall of said receptacle.

5. The apparatus of claim 4 and in addition a hydraulic piston disposed in a bore formed in said stab sub, said hydraulic piston being disposed to jack said stab sub out of said receptacle when hydraulic pressure is removed from said sealing rings and said hydraulic piston is moved from a first to a second position.

6. The apparatus of claim 4 wherein said receptacle is provided with multiple hydraulic connections that terminate in multiple port openings in the wall of said receptacle and said stab sub is provided with multiple port openings that align with the port openings in said receptacle.

7. A hydraulic stab sub for inserting into a remote receptacle for establishing hydraulic communication with the receptacle, said stab sub comprising:

at least one seal means, said seal means being disposed on said stab sub and being movable between a first position in which the seal means is retracted to a position at least in line with the outer surface of the stab sub and a second position in which the seal means is expanded into sealing engagement with the surface of said receptacle;

expansion means mounted on said stab sub for expanding said seal means into sealing engagement with said receptacle; and removal means mounted on said stab sub for positively removing said stab sub from said receptacle when said seal means is moved to said first position.

8. The stab sub of claim 7 wherein said removal means comprises a hydraulic cylinder.

9. The stab sub of claim 8 wherein said hydraulic cylinder is movable between a first position wherein it is retracted within the stab sub and a second position wherein it extends beyond said stab sub to engage a portion of the receptacle and positively remove the stab sub from said receptacle.

* * * * *